US006478506B1

(12) United States Patent
Figlewicz et al.

(10) Patent No.: US 6,478,506 B1
(45) Date of Patent: Nov. 12, 2002

(54) ROADWAY PAVEMENT MARKER

(75) Inventors: Richard R. Figlewicz, Arlington Heights; Guenter Manigel, West Chicago, both of IL (US)

(73) Assignee: Energy Absorption Systems, Inc., Chicago, IL (US)

( * ) Notice: Subject to any disclaimer, the term of this patent is extended or adjusted under 35 U.S.C. 154(b) by 0 days.

(21) Appl. No.: 09/689,474

(22) Filed: Oct. 12, 2000

(51) Int. Cl.[7] ..... E01F 9/06
(52) U.S. Cl. ..... 404/11; 404/13; 404/16
(58) Field of Search ..... 404/9, 13, 10, 404/11, 14, 15, 16; D10/113; 116/63 R

(56) References Cited

U.S. PATENT DOCUMENTS

| | | | | | |
|---|---|---|---|---|---|
| 3,257,552 | A | * | 6/1966 | Converso | 362/390 |
| 3,292,506 | A | * | 12/1966 | Kone | 404/11 |
| 3,850,536 | A | * | 11/1974 | Kone | 404/11 |
| 4,504,169 | A | | 3/1985 | Jones | |
| 4,595,312 | A | * | 6/1986 | Corless | 116/63 R |
| 4,597,691 | A | | 7/1986 | Clarke | |
| 4,955,982 | A | | 9/1990 | Paulos | |
| 5,302,048 | A | | 4/1994 | Paulos et al. | |
| 5,857,801 | A | * | 1/1999 | Brown | 404/11 |
| 6,050,742 | A | * | 4/2000 | Held et al. | 404/10 |
| 6,062,766 | A | * | 5/2000 | Fleury et al. | 404/10 |

FOREIGN PATENT DOCUMENTS

| | | |
|---|---|---|
| WO | WO 97/33045 | 9/1997 |
| WO | WO 99/06635 | 2/1999 |
| WO | WO 99/36629 | 7/1999 |

* cited by examiner

*Primary Examiner*—Gary Hartmann
(74) *Attorney, Agent, or Firm*—Brinks Hofer Gilson & Lione

(57) ABSTRACT

A roadway pavement marker includes a base that supports a flexible membrane. The membrane supports an anchor plate, and the anchor plate in turn supports a reflector housing. The reflector housing is releasably secured to the anchor plate by one or more mechanical fasteners accessible from a side of the membrane opposite the base.

25 Claims, 4 Drawing Sheets

ROADWAY PAVEMENT MARKER

BACKGROUND

This invention relates to roadway pavement markers of the type that include a resilient membrane designed to allow a reflector housing to move out of the path of a snowplow blade.

There have been a number of efforts to provide a snowplowable pavement marker that includes a resilient membrane supporting a reflector housing. See, for example, Held U.S. Pat. No. 6,062,766, Corless U.S. Pat. No. 4,595,312, Clarke U.S. Pat. No. 4,597,691, and Kone U.S. Pat. No. 3,850,536.

The pavement markers described in the Corless and Clarke patents use one or more exposed threaded fasteners to secure a reflector assembly to a rigid element that is supported by a resilient membrane in the center of the pavement marker. Such exposed fasteners provide disadvantages. Since they are exposed, they are more subject to salt damage and corrosion, and in an extreme case they have the potential of snagging on an oncoming snowplow blade. If this happens, the fastener may in principle be damaged or pulled completely out of the pavement marker. Furthermore, exposed fasteners of the type used in the Corless and Clarke patents can be targets of vandalism since they are readily visible to any bypasser.

The pavement marker described in the Kone patent provides a reflector assembly that is received in a channel defined by metallic element embedded in the resilient membrane. This approach suffers from the disadvantage that the reflector assembly can be removed from the channel by sliding it out of the channel.

A need presently exists for an improved pavement marker that is less subject to the disadvantages described above.

BRIEF SUMMARY

The pavement marker described below includes a reflector housing that is carried by an anchor plate that is in turn carried by a resilient membrane. The reflector housing is secured to the anchor plate by mechanical fasteners such as threaded screws, and the mechanical fasteners are hidden by reflectors that are adhesively secured to the reflector assembly. With this approach, the elements of the reflector housing that protect the reflectors from snowplow damage simultaneously serve the function of protecting the mechanical fasteners from damage. When it is necessary to replace a reflector housing, access can be gained to the threaded fasteners by prying the reflectors loose, thereby exposing the threaded fasteners.

The foregoing paragraph has been provided by way of general introduction, and it is not intended to limit the scope of this invention.

DETAILED DESCRIPTION OF THE PRESENTLY PREFERRED EMBODIMENTS

Figure 1:
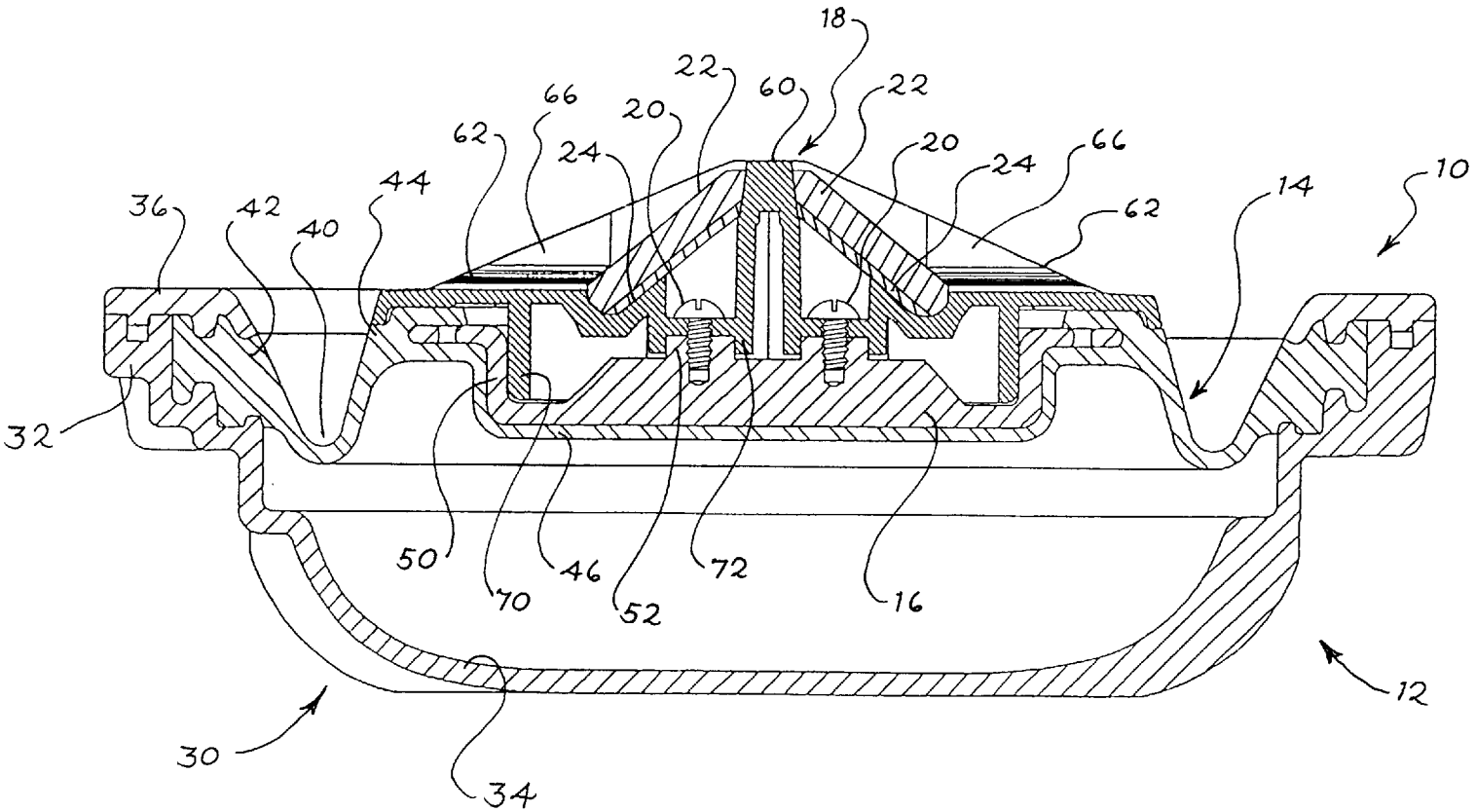
FIG. 1 is a cross-sectional view of a roadway pavement marker that incorporates a preferred embodiment of this invention.

FIG. 1 shows a cross-sectional view of a presently preferred pavement marker 10 that includes a base 12 that surrounds and is secured to the outer perimeter of a flexible, resilient membrane 14. The membrane 14 carries an anchor plate 16, and the anchor plate 16 in turn carries a reflector housing 18. Two mechanical fasteners 20 such as threaded fasteners (self-tapping screws in this example) releasably secure the reflector housing 18 to the anchor plate 16. The reflector housing 18 carries a pair of retro-reflectors 22, each held in place by a respective layer of adhesive 24.

The base 12 includes a lower portion 30 and a ring 36. The lower portion 30 defines a rim 32 and a central portion 34 that is surrounded by the rim 32. The rim 32 and the ring 36 are generally circularly symmetrical, and the rim 32 and the ring 36 define ridges shaped to interlock with the outer edge of the membrane 14. The lower portion 30 and the ring 36 in this example are injection molded from a suitably tough and rigid resin, and the ring 36 is secured to and sealed against the entire periphery of the rim 32. In this way, the outer perimeter of the membrane 14 is securely clamped between the ring 36 and the lower portion 30 in a substantially air- and water-tight seal.

The membrane 14 is generally circularly symmetrical. As shown in FIG. 1, the membrane 14 includes an annular trough 40 that extends upwardly to an outer ridge 42 and to an inner ridge 44. The outer ridge 42 defines an array of grooves shaped to receive the ridges of the ring 36 and the lower portion 30 described above. The inner annular ridge 44 is secured to the outer perimeter of the anchor plate 16 in another air- and water-tight seal. Preferably, the membrane 14 includes a sealing layer 46 that extends over the entire lower surface of the anchor plate 16 such that the membrane 14 extends in an uninterrupted, sealing fashion over the entire area bounded by the rim 32. The sealing layer 46 is not required in all embodiments, and may be deleted if desired. In this case, the membrane 14 is an annular as opposed to a disk-shaped element, and the desired seal is maintained at the interface between the membrane 14 and the anchor plate 16.

Figure 2:
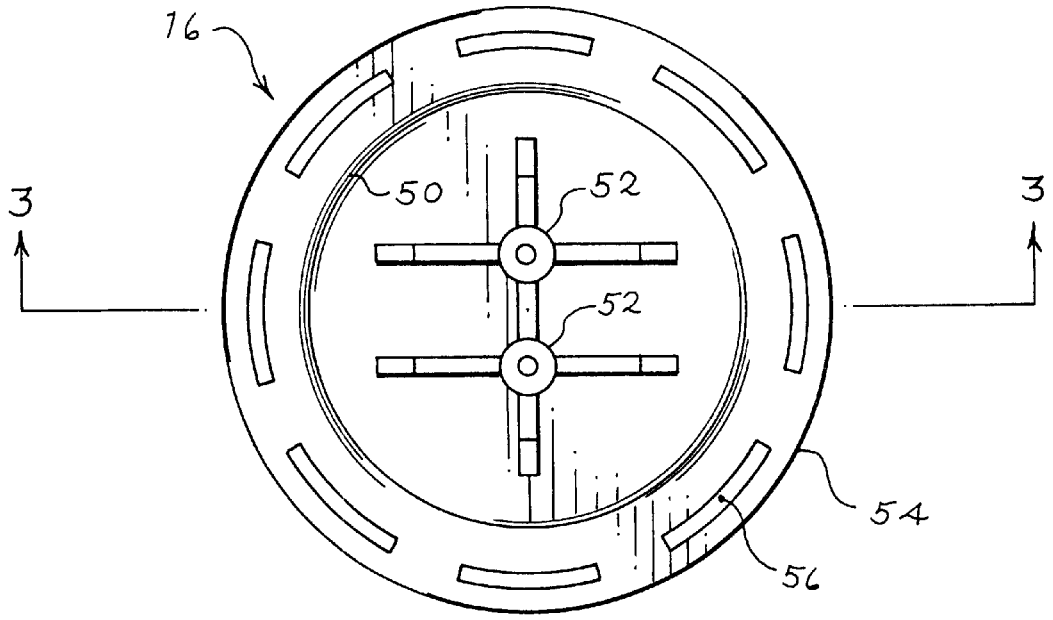
FIG. 2 is a top view of the anchor plate of FIG. 1.
Figure 3:
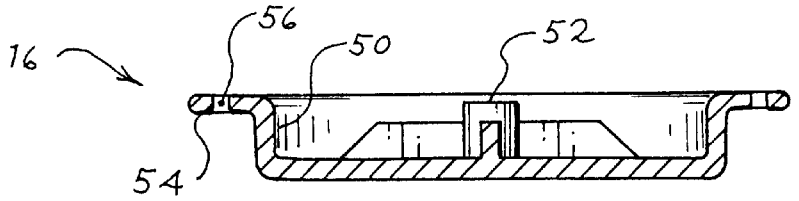
FIG. 3 is a cross sectional view taken along line 3—3 of FIG. 2.

FIGS. 2 and 3 show top and sectional views of the anchor plate 16, prior to the time it is secured to the membrane 14. As shown in FIGS. 1 and 2, the anchor plate 16 includes a sidewall 50 and two bosses 52. The outer perimeter of the anchor plate 16 is formed by a flange 54 that defines openings 56. In this preferred embodiment, the anchor plate 16 is insert molded in the membrane 14 such that the resin of the membrane 14 passes through the openings 56, thereby securely attaching the membrane 14 to the anchor plate 116. The membrane 14 can be formed of any material that is sufficiently resilient and rugged, and the anchor plate 16 and the reflector housing 18 car be formed of any material that is sufficiently rigid and rugged.

Figure 4:
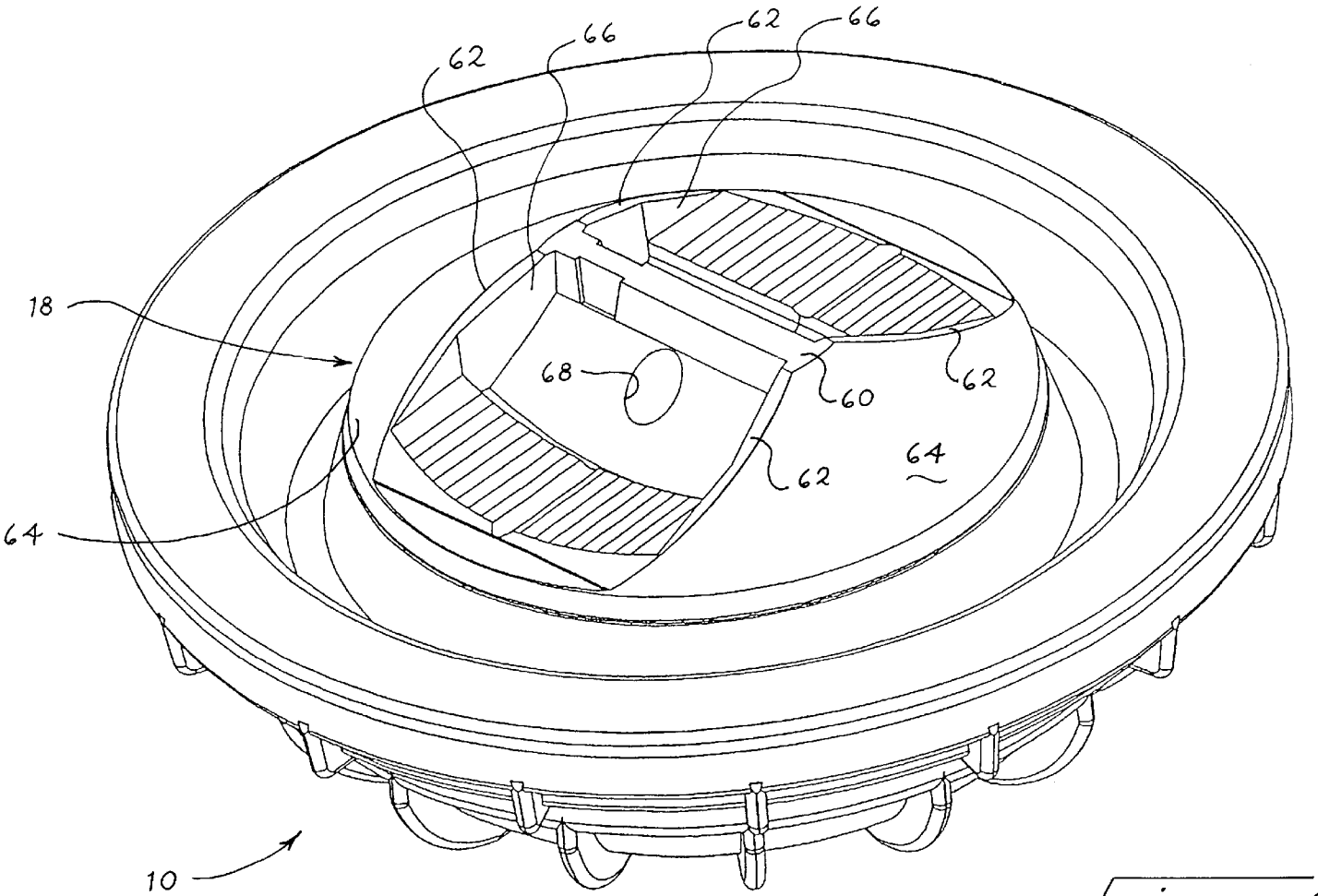
FIG. 4 is an upper perspective view of the pavement marker of FIG. 1, prior to installation of the reflectors in the reflector housing.

FIG. 4 shows a perspective view of the pavement marker 10 prior to installation of the reflectors 22. As shown in FIG. 4, the reflector housing 18 includes a central ridge 60 disposed between two pairs of ramps 62, each pair positioned on a respective side of the ridge 60. The reflector housing 18 also includes two curved ends 64 that rise to meet the ramps 62. The ridge 60, the ramps 62 and the ends 64 cooperate to form two recesses 66 that are substantially protected from impact with snowplow blades. An opening 68 is positioned in each of the recesses 66. The reflector housing 18 defines a downwardly extending cylindrical skirt 70 shaped to fit within the recess formed by the sidewall 50 and two boss-receiving recesses 72, each positioned to receive a respective one of the bosses 52 (FIG. 1). The mechanical engagement between the skirt 70 and the sidewall 50 and between the boss-receiving recesses 72 and the bosses 52 prevents the reflector housing 18 from moving laterally with respect to the anchor plate 16. The fasteners 20 prevent the reflector housing 18 from lifting off of the anchor plate 16.

The pavement marker 10 of FIG. 1 can be assembled by first insert molding the membrane 14 around the anchor plate 16 to form a subassembly that is assembled between the rim 32 and the ring 36 of the base 12. Then the ring 36 is securely attached and sealed to the rim 32, as for example by an ultrasonic weld that extends continuously over the entire 3600 circumference of the rim 32. In this way, a durable air- and water-tight seal is formed that prevents the introduction of water into the space bounded below by the base 12 and above by the membrane 14. Then the reflector housing 18 is secured to the anchor plate 16 with the mechanical fasteners 20. Finally, the reflectors 22 are secured to the reflector housing 16 over the fasteners 20 with the adhesive 24. Once fully assembled, the reflectors 22 obstruct access to the fasteners 20. The fasteners 20 are positioned well within the recesses 66, such that the fasteners 20 are protected from contact with salt and other damaging compositions as well as from impact against objects such as snowplow blades or tires striking the upper portion of the pavement marker 10.

Figure 5:
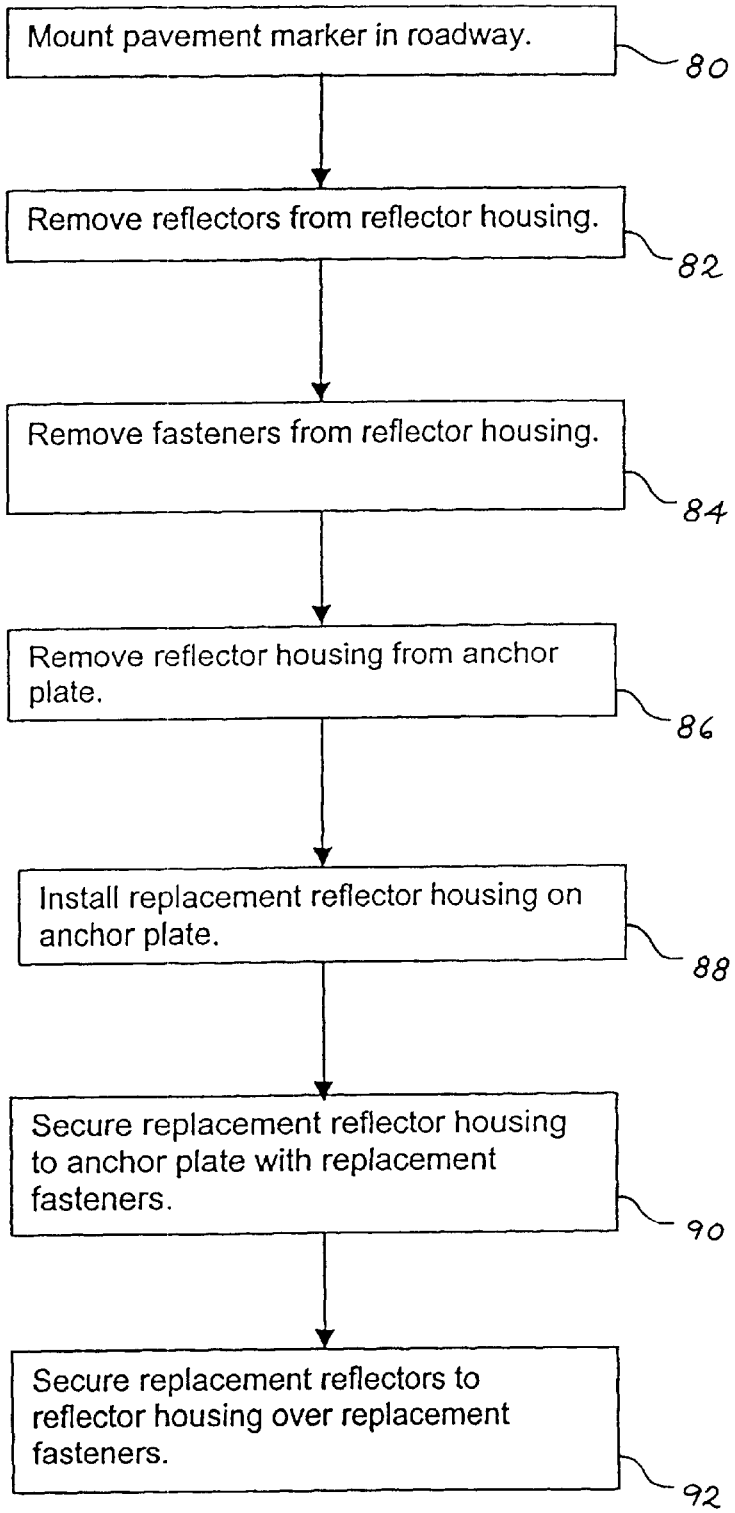
FIG. 5 is a flowchart of a method for replacing the reflector housing of FIG. 1.

FIG. 5 provides a flowchart of a method for installing and then repairing the pavement marker 10 of FIGS. 1–4. In block 80 the pavement marker is mounted in a roadway using any conventional techniques. For example, a recess may be drilled in the upper surface of the roadway with a suitable tool, as described in U.S. Pat. No. 6,062,766, hereby incorporated by reference. Then, a suitable adhesive, such as that described in U.S. Pat. No. 6,062,766, is placed in the recess, and the pavement marker is held in position at the desired depth with a suitable weight until the adhesive has cured. Preferably, the upper surface of the ring 36 is positioned below the surface of the roadway to reduce any tendency of an on-coming snowplow blade to snag on the ring 36.

Typically, an extensive time period will pass until refurbishment is required for the reflector housing. However, in the event repair or replacement of the reflector housing is required, this can easily be accomplished using the method of FIG. 5. In block 82, the reflectors are removed from the reflector housing. This can be done by prying them out of position with a suitable prying tool (not shown), thereby producing the configuration shown in FIG. 4. In FIG. 4 the roadway has not been shown for clarity of illustration. Once the reflectors have been removed from the housing, the fasteners are exposed, and in block 84 the fasteners are loosened and then removed from the reflector housing. When the fasteners are threaded fasteners, this is done by rotating the fasteners in a fastener-loosening direction. Once the fasteners have been removed, the reflector housing is removed from the anchor plate in block 86.

Next, a replacement reflector housing is installed on the anchor plate in block 88, and the replacement reflector housing is secured in place to the anchor plate with replacement fasteners in block 90. When the replacement fasteners are threaded fasteners, this is done by rotating the replacement fasteners in a fastener-tightening direction. Finally, replacement reflectors are secured to the reflector housing with additional adhesive in block 92, thereby restoring the pavement marker to its original configuration and obscuring access to the replacement fasteners.

Simply by way of example, the materials of Table 1 have been found suitable in one practical implementation of this invention. If desired, a heat-activated adhesive such as Chemlok™ (Lord Chemical Co.) may be used to create an improved bond between the membrane 14 and the anchor plate 16. Of course, many alternatives are possible, and these examples are not intended to be limiting.

TABLE 1

| PREFERRED MATERIALS | |
|---|---|
| Base 12 (including ring 36) and anchor plate 16 | 33% glass filled Nylon (e.g. Dupont Zyte ™) |
| Membrane 14 | Thermoplastic Urethane or Santoprene ™ |
| Reflector housing 18 | 60% glass-filled Nylon (e.g. DuPont Isoplast GFPU ™) |
| Fastener 20 | Stainless Steel |
| Reflector 22 | Acrylic |
| Adhesive 24 | Acrylic foam tape with acrylic adhesive (e.g. 3M #4941 VHB) |

Many variations are possible to the preferred embodiment described above. The mechanical fasteners can take many different forms, including threaded bolts that cooperate with threaded nuts mounted in the anchor plate, and threaded nuts that cooperate with threaded studs mounted in the anchor plate. Also, other types of mechanical fasteners can be used, including spring clips and split rings that mechanically engage the anchor plate. As another example, bayonet fasteners can be used. In general, the term "mechanical fastener" is intended broadly to encompass a wide variety of fasteners that releasably mechanically interlock with the anchor plate, including mechanical fasteners that are not rotated to install or remove.

The base can be formed in many different configurations, and many different types of seals can be used between the base and the membrane. For example, adhesives and various mechanical interlocking arrangements can be used to secure the base around the membrane.

The pavement marker described above can be used in any roadway, including highways, racetracks and other surfaces intended to support wheeled vehicles, and the term "roadway" is intended to encompass all such surfaces.

The number of reflectors carried by the reflector housing and the number of fasteners used to secure the reflector housing to the anchor plate can be varied. For example, only a single reflector can be used in some examples, and more than two reflectors can be used in others. Only one fastener can be used, or the number may be greater than two. For example, two fasteners can be provided under each reflector. As used herein, the term "set" is intended broadly to encompass one or more elements.

The anchor plate can take many shapes and configurations, and it is not limited to the illustrated structure. The important aspect of the anchor plate is that it have a surface shaped to carry the reflector housing, and the anchor plate does not have to define any planar surfaces or any specific ratio of thickness to maximum cross-sectional dimension.

In the foregoing description of the method of FIG. 5, reference was made to replacement fasteners, a replacement reflector housing and replacement reflectors. It should be understood that the replacement fasteners may be the identical fasteners that were removed from the pavement marker in block 84, or they may be new fasteners. Similarly, the replacement reflector housing may be the reflector housing that was removed from the pavement marker in block 86, or it may be a new reflector housing; and the replacement reflectors may be the reflectors that were removed in block 82 or new reflectors.

As used, herein, terms of orientation such as "above" and "below" are intended to be applied with the pavement marker in its normal use position in a roadway.

The foregoing detailed description has described only a few of the many forms that this invention can take. For this reason, this detailed description is intended only by way of illustration and not limitation. It is only the following claims, including all equivalents, that are intended to define the scope of this invention.

What is claimed is:

1. A roadway pavement marker comprising:

a base comprising a central portion and a rim extending round the central portion;

a resilient membrane carried by the base and extending inwardly from the rim over at least part of the central portion;

an anchor plate carried by the membrane;

a reflector housing carried by the anchor plate, said reflector housing having a first side facing toward said anchor plate and a second side facing away from said anchor plate;

a set of mechanical fasteners releasably securing the reflector housing to the anchor plate, wherein said set of mechanical fasteners are accessible from said second side of said reflector housing; and a set of reflectors carried by the reflector housing.

2. The invention of claim 1 wherein the resilient membrane extends under the anchor plate as an uninterrupted sealing layer extending over an entire area bounded on all sides by the rim.

3. The invention of claim 1 wherein the set of fasteners comprises two fasteners wherein the set of reflectors comprises two reflectors, and wherein the reflectors are positioned on respective opposed sides of a ridge formed by the reflector housing.

4. The invention of claim 1 further comprising an adhesive securing each said reflector to the reflector housing.

5. The invention of claim 1 wherein the membrane comprises a single annular trough that extends around the anchor plate, said trough rising to an outer annular ridge adjacent the rim and to an inner annular ridge adjacent the anchor plate.

6. The invention of claim 1 wherein the reflector housing comprises first and second recesses, wherein the set of reflectors comprises two reflectors, each disposed in a respective one of the recesses, and wherein the set of fasteners comprises two fasteners.

7. The invention of claim 1 wherein each said fastener comprises a respective threaded fastener.

8. The invention of claim 7 wherein each threaded fastener comprises a head and a threaded portion, wherein each of said threaded portions is positioned between the corresponding head of said threaded fastener and said base.

9. The invention of claim 1 wherein at least one of said set of fasteners is disposed under at least one of said set of reflectors, wherein said at least one reflector obstructs access to said at least one fastener.

10. The intention of claim 9 wherein each of said fasteners is disposed under a respective one of said reflectors, wherein said reflectors obstruct access to said fasteners.

11. A roadway pavement marker comprising:

a base comprising a central portion and a rim extending round the central portion;

a resilient membrane carried by the base and extending inwardly from the rim over at least part of the central portion;

an anchor plate carried by the membrane;

a reflector housing carried by the anchor plate, said reflector housing having a first side facing toward said anchor plate and a second side facing away from said anchor plate;

a mechanical fastener releasably securing the reflector housing to the anchor plate, wherein said mechanical fastener is accessible from said second side of said reflector housing; and a reflector carried by the reflector housing.

12. The invention of claim 11 wherein the fastener comprises a threaded fastener.

13. The invention of claim 12 wherein said threaded fastener comprises a head and a threaded portion, wherein said threaded portion is positioned between the head of said threaded fastener and said base.

14. The invention of claim 11 wherein the resilient membrane extends under the anchor plate as an uninterrupted sealing layer extending over an entire area bounded on all sides by the rim.

15. The invention of claim 11 further comprising an adhesive securing the reflector to the reflector housing.

16. The invention of claim 11 wherein the reflector assembly comprises a recess, and wherein the reflector is disposed in the recess.

17. The invention of claim 11 wherein said fastener is disposed under said reflector, wherein said reflector obstructs access to said fastener.

18. A method for repairing a pavement marker, said method comprising:

(a) mounting a pavement marker in a roadway, said pavement marker comprising a base comprising a central portion and a rim extending around the central portion; a resilient membrane carried by the base and extending inwardly from the rim over at least part of the central portion; an anchor plate carried by the membrane; a reflector housing carried by the anchor plate, said reflector housing having a first side facing toward said anchor plate and a second side facing away from said anchor plate; a mechanical fastener releasably securing the reflector housing to the anchor plate, wherein said mechanical fastener is accessible from said second side of said reflector housing; and a reflector carried by the reflector housing; then (b) loosening the mechanical fastener from said second side of said reflector housing without separating the membrane from the base; then (c) removing the reflector housing from the anchor plate; then (d) installing a replacement reflector housing on the anchor plate; and then (e) securing the replacement reflector housing to the anchor plate with a replacement mechanical fastener.

19. The method of claim 18 wherein (b) comprises rotating the fastener in a fastener-loosening direction.

20. The method of claim 18 wherein (e) comprises rotating the replacement fastener in a fastener-tightening direction.

21. The invention of claim 11 wherein said reflector is disposed over the mechanical fastener such that the reflector obstructs access to the mechanical fastener, and further comprising removing the reflector from the reflector housing before said loosening the mechanical fastener, and securing a replacement reflector to the reflector housing over the mechanical fastener after said securing the replacement reflector housing to the anchor plate with said replacement mechanical fastener.

22. The method of claim 21 wherein the reflector of (a) is secured to the reflector housing by an adhesive, and wherein said removing the reflector from the reflector housing comprises prying the reflector away from the reflector housing.

23. The method of claim 21 wherein said securing said replacement reflector to the reflector housing over the replacement fastener comprises adhesively securing the replacement reflector to the reflector housing over the replacement fastener.

24. The method of claim 18 wherein the fastener comprises a threaded fastener.

25. The invention of claim 24 said threaded fastener comprises a head and a threaded portion, wherein said threaded portion is positioned between the head of said threaded fastener and said base.

* * * * *

UNITED STATES PATENT AND TRADEMARK OFFICE

CERTIFICATE OF CORRECTION

PATENT NO. : 6,478,506 B1 
DATED : November 12, 2002
INVENTOR(S) : R. R. Figlewicz et al.

It is certified that error appears in the above-identified patent and that said Letters Patent is hereby corrected as shown below:

Column 5,
Line 39, immediately after "fasteners" insert -- , -- (comma).

Column 7,
Line 1, delete "claim 11" and substitute -- claim 18 -- in its place.

Signed and Sealed this

Twelfth Day of August, 2003

JAMES E. ROGAN
*Director of the United States Patent and Trademark Office*